US009396670B2

(12) United States Patent
Kolton et al.

(10) Patent No.: US 9,396,670 B2
(45) Date of Patent: Jul. 19, 2016

(54) ELECTRONIC TAG HOLDER FOR CAPPED BOTTLE NECK

(75) Inventors: Chester Kolton, Westfield, NJ (US); Michael Norman, East Brunswick, NJ (US); Alex Tetiyevsky, Springfield, NJ (US)

(73) Assignee: B&G International, Inc., Union, NJ (US)

( * ) Notice: Subject to any disclaimer, the term of this patent is extended or adjusted under 35 U.S.C. 154(b) by 1515 days.

(21) Appl. No.: 12/625,052

(22) Filed: Nov. 24, 2009

(65) Prior Publication Data

US 2010/0133224 A1 Jun. 3, 2010

Related U.S. Application Data

(60) Provisional application No. 61/119,484, filed on Dec. 3, 2008.

(51) Int. Cl.

| | |
|---|---|
| ***G09F 3/03*** | (2006.01) |
| ***G09F 3/16*** | (2006.01) |
| ***G09F 23/06*** | (2006.01) |
| *G09F 3/02* | (2006.01) |

(52) U.S. Cl.

CPC ..... *G09F 3/0323* (2013.01); *G09F 3/0329* (2013.01); *G09F 3/16* (2013.01); *G09F 23/06* (2013.01); *B65D 2203/10* (2013.01); *B65D 2211/00* (2013.01); *G09F 2003/0273* (2013.01)

(58) Field of Classification Search

CPC ..... B65D 1/023; B29B 2911/1402; B29B 2911/14026; B29B 2911/14033; B29B 2911/1404

USPC ..... 215/40, 6, 386, 221; 340/572.1, 572.8, 340/572.9, 693.9; 70/57.1, 54; D10/104, D10/106, 116

See application file for complete search history.

(56) References Cited

U.S. PATENT DOCUMENTS

| | | | | |
|---|---|---|---|---|
| 3,685,676 | A | 8/1972 | Gach et al. | |
| 3,756,444 | A | 9/1973 | McIntosh | |
| 3,853,236 | A | 12/1974 | Ostrowsky | |
| 3,902,339 | A * | 9/1975 | Carley | E05B 67/38 70/54 |
| 3,915,326 | A | 10/1975 | Hrubesky | |
| 4,018,640 | A | 4/1977 | Amberg | |
| 4,089,463 | A | 5/1978 | Babiol | |
| 4,176,756 | A | 12/1979 | Gellman | |
| 4,405,161 | A | 9/1983 | Young et al. | |
| 4,457,445 | A | 7/1984 | Hanks et al. | |
| 4,471,982 | A | 9/1984 | Nielsen et al. | |
| 4,674,778 | A | 6/1987 | Ruiz | |
| 4,729,487 | A | 3/1988 | Wright | |
| 4,813,564 | A | 3/1989 | Cooper et al. | |

(Continued)

FOREIGN PATENT DOCUMENTS

| | | | |
|---|---|---|---|
| GB | 2465892 | A | 6/2010 |
| WO | 2007/086984 | A1 | 8/2007 |
| WO | 2008/075310 | | 6/2008 |

*Primary Examiner* — Fenn Mathew
*Assistant Examiner* — Cynthia Collado
(74) *Attorney, Agent, or Firm* — Hoffmann & Baron, LLP

(57) ABSTRACT

A housing assembly supports an electronic tag to the extending neck of a bottle. The housing assembly includes a housing for accommodating the electronic tag. The housing has an annular bearing surface for engagement with the extending neck of the bottle. A strap is coupled to the housing about the bottle neck. The strap has a bearing surface for engagement with the extending neck where the bearing surface of the strap is tapered to match the taper of the extending neck of the bottle.

10 Claims, 3 Drawing Sheets

(56) References Cited

U.S. PATENT DOCUMENTS

| | | | | |
|---|---|---|---|---|
| 5,230,541 | A * | 7/1993 | Nowak | E05C 19/18 24/16 PB |
| 5,602,530 | A | 2/1997 | Holmgren | |
| 5,667,085 | A | 9/1997 | Ogden et al. | |
| 6,137,413 | A | 10/2000 | Ryan, Jr. | |
| 6,254,139 | B1 | 7/2001 | Fresnel | |
| 6,342,838 | B1 | 1/2002 | Kolton et al. | |
| 6,604,643 | B1 | 8/2003 | Michael et al. | |
| 6,696,955 | B2 | 2/2004 | Kolton et al. | |
| 6,831,552 | B2 | 12/2004 | Lin | |
| D506,694 | S * | 6/2005 | Corney | D10/106.94 |
| 7,048,179 | B2 | 5/2006 | Claessens et al. | |
| 7,061,382 | B2 | 6/2006 | Claessens et al. | |
| 7,394,383 | B2 | 7/2008 | Hager et al. | |
| 2006/0151414 | A1 | 7/2006 | Mullen | |
| 2007/0062903 | A1 | 3/2007 | Norman et al. | |
| 2007/0285243 | A1 | 12/2007 | Feibelman | |
| 2008/0030334 | A1 * | 2/2008 | Marsilio | E05B 73/0017 340/572.1 |
| 2008/0048868 | A1 | 2/2008 | Chua et al. | |
| 2008/0230509 | A1 * | 9/2008 | Koo | F17C 13/003 215/386 |
| 2008/0289372 | A1 | 11/2008 | Rendon et al. | |
| 2010/0085191 | A1 | 4/2010 | Kolton et al. | |
| 2010/0253524 | A1 | 10/2010 | Kolton et al. | |
| 2011/0074583 | A1 | 3/2011 | Kolton et al. | |

* cited by examiner

ELECTRONIC TAG HOLDER FOR CAPPED BOTTLE NECK

CROSS-REFERENCE TO RELATED APPLICATION

This application claims priority to U.S. Provisional Patent Application No. 61/119,484, filed on Dec. 3, 2008, which is incorporated herein by reference.

FIELD OF THE INVENTION

The present invention relates generally to a holder for an electronic tag. More particularly, the present invention relates to a holder for an electronic tag which may be applied to a capped bottle neck.

BACKGROUND OF THE INVENTION

Electronic tags are used for a wide variety of purposes, including the tracking of items which contain the tag, inventory control, security, and also provide information which may be electronically readable.

These tags or markers may include radio frequency identification (RFID) tags or electronic article surveillance (EAS) tags. EAS tags may be used to provide theft deterrence. These tags are used in combination with an alarm system which monitors undesired movement of the article containing the EAS tag.

Various housings for such tags have been developed which accommodate the electronic tag and which attach the tags to the desired article. It is desired that the tags be securely supported to the article in such a manner where it remains with the article until the time of purchase.

With respect to some articles, such as beverage bottles, various housings have been developed to secure the tag to different locations on the bottle. One troublesome location to apply tags is to the outside surface of a tapered neck of the bottle. While this is a desirous location to apply the tag, it is difficult to attach the tag and maintain the tag on the neck.

It is therefore desirable to provide a tag housing which may be secured about the neck of a bottle.

SUMMARY OF THE INVENTION

A housing assembly is provided for supporting an electronic tag to an extending neck of a bottle. The housing assembly includes a housing for accommodating the electronic tag. The housing includes an annular bearing surface for engagement with the extending neck of a bottle. The strap is lockingly coupled to the housing about the bottle neck. The strap has a bearing surface for engagement with the extending neck. The bearing surface is tapered to match the taper of the extending neck of the bottle.

DETAILED DESCRIPTION OF THE INVENTION

The present invention provides a housing assembly for supporting electronic tag on the neck of a bottle.

Figure 1:
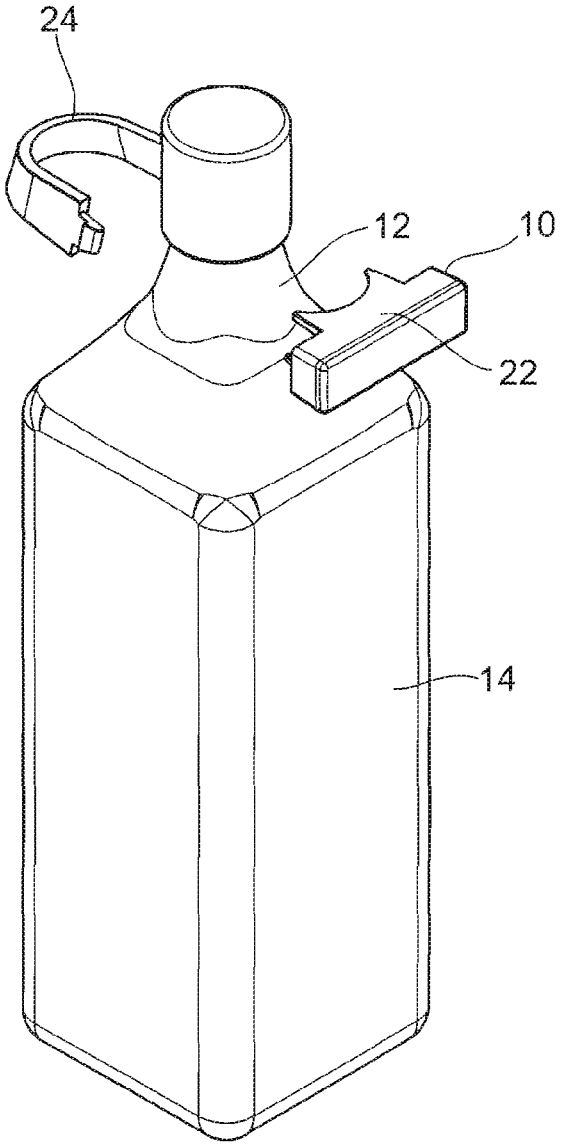
FIGS. 1 and 2 are perspective views of the tag housing assembly of the present invention attached to the extending neck of a bottle.
Figure 2:
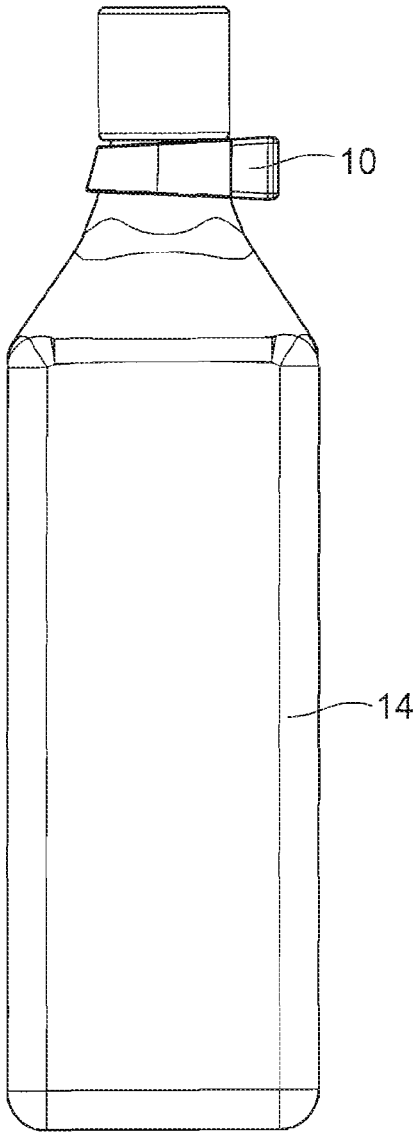
Figure 3:
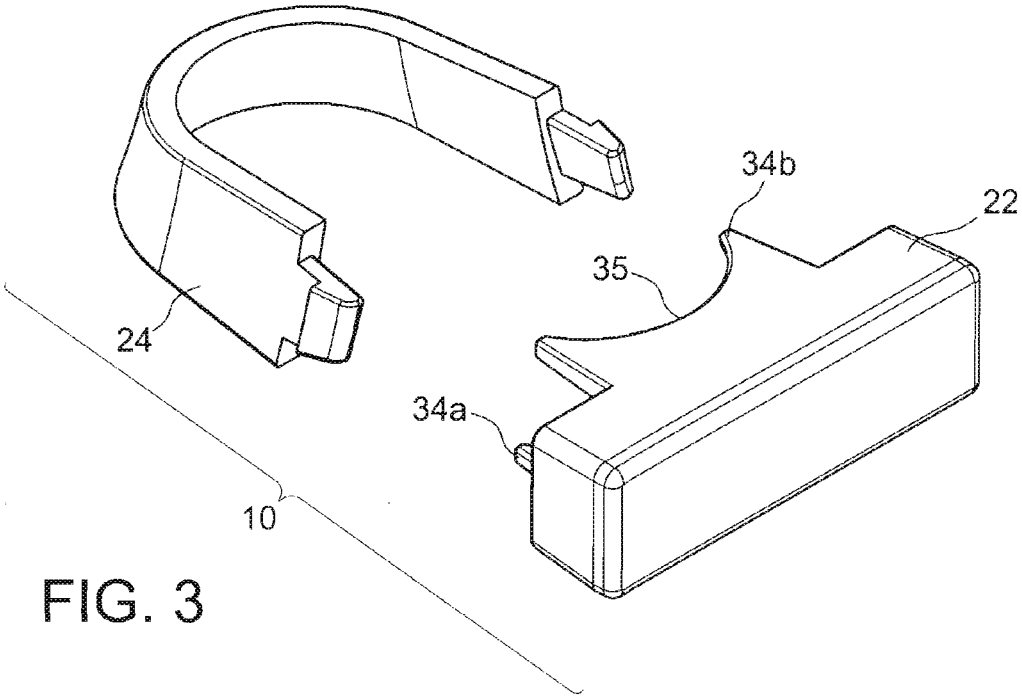
FIG. 3 is an exploded view of the tag housing assembly of the present invention.

Referring to FIGS. 1 and 2, a tag housing assembly 10 may be supported on the neck 12 of a bottle 14. The tag housing assembly 16 includes a housing 22 and a strap 24 which is attachable to the housing 22 about the elongate extending neck 12 of bottle 14. Housing 22 as well as strap 24 may be formed of a suitable plastic material such as high impact polystyrene.

Figure 4:
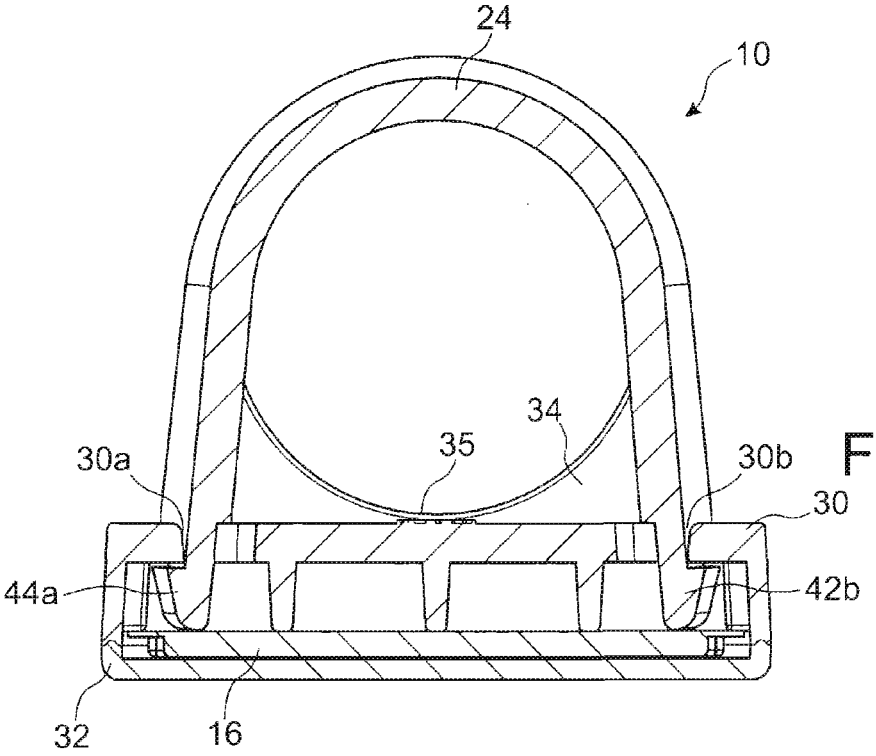
FIG. 4 is a sectional showing of the assembled tag housing assembly of FIG. 3.
Figure 5:
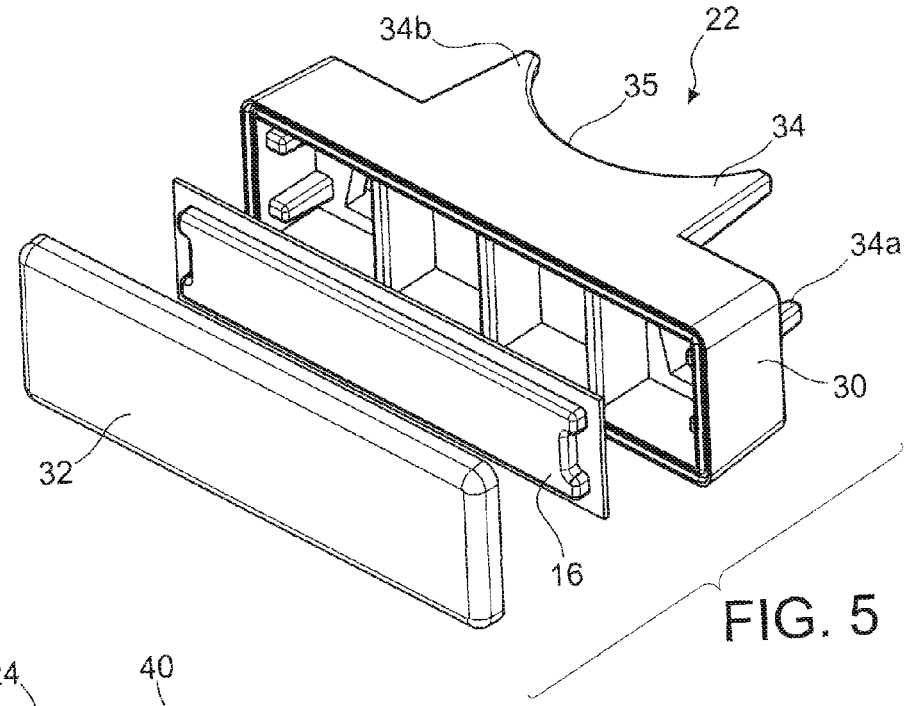
FIG. 5 is an exploded view of the base of the tag housing assembly of FIG. 3.

As shown in FIGS. 4 and 5, the housing assembly 10 supports an electronic tag 16 which may be a radio frequency identification (RFID) tag or an electronic article security tag (EAS) tag or any similar electronic tag. The present invention is designed to attach the electronic tag 16 to bottle 14 having a removable cap 20 (FIGS. 1 and 2) which prevents the tag housing 10 from being removed from the neck 12 of the bottle.

Referring now to FIG. 5, the housing 22 of the housing assembly 10 of the present invention is shown. Housing 22 includes a base 30 and a cover 32 which is ultrasonically welded to the base. The base and cover support therebetween the electronic tag 16. The base includes an extending semicircular neck engagement portion 34 which includes a pair of identically formed spaced apart arcuate extensions 34*a* and 34*b* which are designed for engagement with the neck of the bottle. The extensions 34*a* and 34*b* define an arcuate nest 35 which seats against the bottle neck. Housing base 30 further includes a pair of spaced apart recesses 30*a* and 30*b*. The recesses are designed for accommodating latches of strap 24 as will be described hereinbelow.

Figure 6:
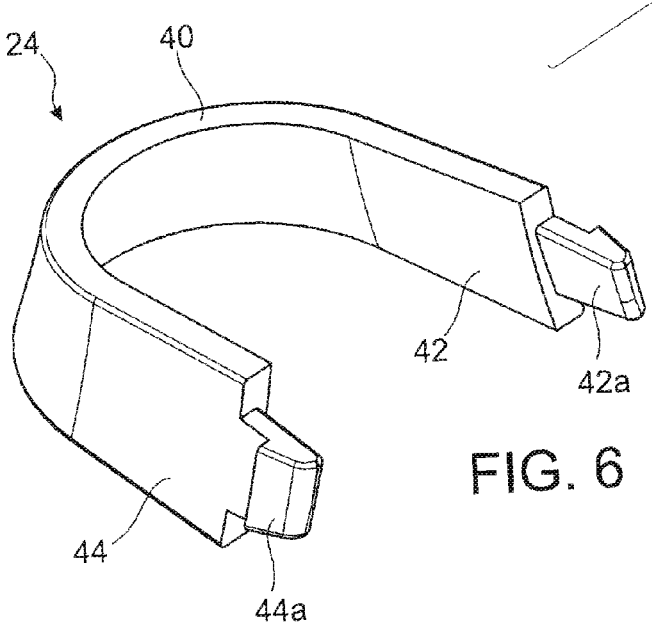
FIG. 6 is a perspective view of the strap of the tag housing assembly of FIG. 3.
Figure 7:
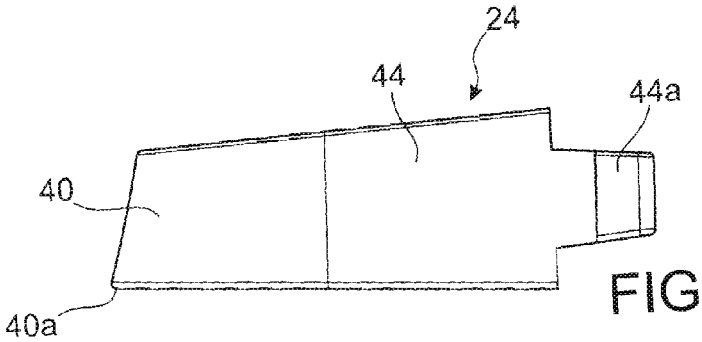
FIG. 7 is a side view of the strap of FIG. 6.

Referring to now to FIGS. 6 and 7, strap 24 is shown. Strap 24 is a generally U-shaped member having an arcuate base 40 and a pair of extending arms 42 and 44. The distal ends of the arms 42 and 44 include insertable latches 42*a* and 44*a*. The latches are designed for one way snap fit accommodation in recesses 30*a* and 30*b* formed in housing base 30.

One feature of the present invention is that the arcuate base 40 of strap 24 is tapered as shown in the side view of FIG. 7. This taper allows the strap to be tightly supported against the tapered bottle neck 12 as shown in FIGS. 1 and 2. The bottom portion 40*a* of the arcuate base 40 extends at an outward angle so as to accommodate the outward taper of the bottle neck. It is contemplated that the strap 24 may be specifically constructed to match any bottle neck to which the housing assembly is attached. Thus, a single housing 22 can be used for any bottle and a specifically constructed strap can be selectively coupled thereto for each bottle to which a tag is desired to be attached. By conforming the strap to the bottle neck, the housing assembly 10 can be secured against the neck. This helps prevent unauthorized detachment of the housing assembly from the bottle.

Referring now to FIGS. 1 and 4, the assembly of the components is shown. The tag 16 is secured in housing base 30 and cover 32 is secured thereto. The housing 22 and the strap 24 can be fitted around the bottle neck as shown in FIG. 1. Thereafter, the latches 42*a* and 44*a* of strap 24 can be inserted into recesses or catches 30*a* and 30*b* formed in the base 30. This snaps the strap into the base preventing nondestructive removal therefrom. As the cover 32 is secured to the base, access to the latches is prevented. The housing 22 and thus the tag 16 cannot be removed without destroying the housing assembly 10 while the cap is in place.

Moreover, the housing assembly is prevented from being removed from the neck of the bottle by the cap 20. The tight coupling of the strap against the bottle neck prevents the housing assembly from being moved upwards. As shown in FIG. 4, when the strap and the housing are secured together, they form an annular structure. The diameter of this structure is less than the diameter of the bottle cap, thereby preventing the housing assembly from being removed from the bottle without first removing the cap. Once the consumer purchases the bottle and removes the cap, the housing assembly may be removed and discarded.

Various changes to the foregoing described and shown structures would now be evident to those skilled in the art. Accordingly, the particularly disclosed scope of the invention is set forth in the following claims.

What is claimed is:

1. A housing assembly for supporting an electronic tag to an extending neck of a bottle, wherein said extending neck has a taper, said housing assembly comprising:

a housing for accommodating said electronic tag, said housing having a housing surface for engagement with said neck of said bottle; and a strap lockingly coupled to said housing about said bottle neck;

said strap having a bearing strap surface for engagement with said extended neck, said bearing surface of said strap being tapered to generally match the taper of the extending neck of said bottle.

2. A housing assembly of claim 1 wherein said housing includes a base and a cover and where said tag is supported between said base and said cover.

3. A housing assembly of claim 2 wherein said cover is secured to said base preventing non-destructible access to said tag.

4. A housing assembly of claim 3 wherein said cover is ultrasonically welded to said base.

5. A housing assembly of claim 2 wherein said housing includes a pair of spaced apart recesses and wherein said strap includes a pair of latches, which said latches are engageable in said recesses preventing removal of said latches therefrom.

6. A housing assembly of claim 1 wherein said housing surface is arcuate.

7. A housing assembly of claim 5 wherein said strap is attachable to said housing in a manner wherein said strap is secured against said neck of said bottle.

8. An assembly comprising:

a bottle having an elongate extending bottle neck and cap removably attached at a distal end thereof, wherein said extending neck has a taper;

a tag housing supporting an electronic tag; and a strap lockingly coupled to said housing about said bottle;

said housing having an arcuate housing surface positioned against said extending neck and said strap having an arcuate bearing surface positioned against said neck wherein said strap bearing surface includes a taper which generally matches the taper of the extending neck so as to prevent removal of said strap and said housing from said bottle.

9. An assembly of claim 8 wherein said housing arcuate surface and said strap arcuate bearing surface defines an annular structure having a diameter less than the diameter of said bottle cap.

10. An assembly of claim 8 wherein said strap is coupled to said housing in a manner wherein said strap is secured against said neck of said bottle.

* * * * *